US009234367B2

(12) United States Patent
Kopp

(10) Patent No.: US 9,234,367 B2
(45) Date of Patent: Jan. 12, 2016

(54) T-POST FENCE ATTACHMENT SYSTEM

(71) Applicant: Michael Kopp, Swan Valley, ID (US)

(72) Inventor: Michael Kopp, Swan Valley, ID (US)

( * ) Notice: Subject to any disclaimer, the term of this patent is extended or adjusted under 35 U.S.C. 154(b) by 0 days.

(21) Appl. No.: 14/554,131

(22) Filed: Nov. 26, 2014

(65) Prior Publication Data

US 2015/0144856 A1 May 28, 2015

Related U.S. Application Data

(60) Provisional application No. 61/909,500, filed on Nov. 27, 2013.

(51) Int. Cl.
*E04H 17/12* (2006.01)

(52) U.S. Cl.
CPC ..... *E04H 17/12* (2013.01)

(58) Field of Classification Search
CPC ..... E04H 17/02; E04H 17/04; E04H 17/10; E04H 17/12; E04H 17/24; E04H 2017/1473; E04H 2017/1447; E04H 2017/1421
See application file for complete search history.

(56) References Cited

U.S. PATENT DOCUMENTS

| | | | | |
|---|---|---|---|---|
| 1,454,254 | A | 5/1923 | Roney | |
| 1,630,441 | A * | 5/1927 | Lotz | E04H 17/24 174/163 F |
| 3,731,429 | A * | 5/1973 | Orthman | A01G 9/12 211/107 |
| 4,763,879 | A | 8/1988 | Wasicek | |
| 4,936,550 | A | 6/1990 | Wickham | |
| D310,780 | S | 9/1990 | Kelley | |
| 4,982,932 | A | 1/1991 | Baker | |
| 5,439,201 | A | 8/1995 | Landreville | |
| 5,440,834 | A * | 8/1995 | Kleinert | A01G 9/12 248/217.1 |
| 6,481,696 | B1 | 11/2002 | Lion | |
| 6,619,627 | B2 | 9/2003 | Salisbury | |
| 6,705,598 | B2 | 3/2004 | Collins | |
| 6,883,785 | B1 | 4/2005 | Knapp | |
| 7,334,370 | B2 * | 2/2008 | Fordyce | E04H 17/22 256/65.14 |
| 8,480,061 | B2 | 7/2013 | Graves | |
| 2001/0040235 | A1 * | 11/2001 | Dwyer | E04H 17/10 256/47 |
| 2004/0026678 | A1 * | 2/2004 | Vandergriff | E04H 17/10 256/47 |

* cited by examiner

*Primary Examiner* — Daniel Wiley
(74) *Attorney, Agent, or Firm* — Daniel Boudwin, Esq.; Global Intellectual Property Agency, LLC

(57) ABSTRACT

A first and second of fence post bracket is provided that function together to secure a wire fence to a T-post fence post. The brackets comprise a complimentary bracket pair that secure a portion of wire fence to a T-post and utilize existing T-post lugs and T-post flanges as support. Each bracket comprises an upstanding portion having a fastener aperture, and a hook end with an open notch. The base of the bracket extends substantially perpendicular to the upstanding portion and includes a U-shaped fitting. The fitting is configured to wrap around the exposed outer edge of a T-post flange, while the upstanding portion is configured to extend away from the post between two T-post lugs. The two brackets are fastened together to provide an enclosed area between the bracket notches and the post, wherethrough a portion of the wire fence is supported.

5 Claims, 5 Drawing Sheets

T-POST FENCE ATTACHMENT SYSTEM

CROSS REFERENCE TO RELATED APPLICATION

This application claims the benefit of U.S. Provisional Application No. 61/909,500 filed on Nov. 27, 2013, entitled "Fence T-Post Bracket Assembly." The above identified patent application is herein incorporated by reference in its entirety to provide continuity of disclosure.

BACKGROUND OF THE INVENTION

1. Field of the Invention

The present invention relates to fence brackets for securing a fence to a fence post. More specifically, the present invention relates to a new and improved structure for securing wire fencing to a fence T-post using a pair of reusable brackets, which facilitate several functional improvements and a more robust attachment design.

Tradition techniques of securing a fence to a fence post include the use of wire tie connections between the post and the wire fence. The fence (barbed wire, chain link, straight wire, or otherwise) is pressed against an upstanding fence post and a length of wire tie is placed through the fence and wrapped around the fence post to secure the two together. The ends of the wire tie are twisted together using pliers to secure the attachment, wherein this process is repeated several times along the length of each fence post.

There are several drawbacks to this method of wire fence attachment. First, the wire tie lengths are generally for single use, and therefore become waste after one use. The wire tie lengths are discarded when replaced, as the wire is not readily workable after it has been tensioned around the post and deployed for a period of time. Secondly, the method of attaching wire lengths along a post and then along an entire fence line is laborious and time consuming. Each of the wire ties needs to be cut and fed through the fence, around the fence post, and then twisted together to make the connection using a pair of hand pliers. A more efficient means is therefore desired.

Furthermore, the use of traditional wire tie attachments to secure a wire fence does not offer the same advantages as provided by a more robust, structural bracket or clip. The wire tie connection relies on tension in the wire tie and thus draws the fence abuttingly against the fence post. This does not allow the fence to "float," whereby the wire fence could otherwise adjust to a farm animal bearing against the fence or allow for positional readjustment during installation.

To address these drawbacks and to fulfill a long felt need in the art, the present invention contemplates a set of structural brackets that secures a wire fence to a fence T-post. Specifically, the present invention provides a set of structural brackets that are uniquely configured to retain a wire fence (e.g. barbed wire, woven wire, chain linked, straight wire, etc.) when supported against a fence T-post. Fence T-posts include a T-shaped cross section and a line of lugs along the cap thereof, whereagainst the wire fence is pressed and usually wire tied thereto. The lugs generally extend through the openings of the wire fence to lock a specific opening to a lug and to prevent movement along the fence post after being wire tied. The present invention replaces the traditional wire tie with a pair of brackets that are supported between the lugs of the T-post, secured around the exposed ends of the T-post cap flanges, and fastened together using a threaded bolt to create a static joint. The brackets support the wire fence in a floating condition, are more readily applied to the fence post during installation of the wire fence, and are reusable after initial deployment.

2. Description of the Prior Art

Devices have been disclosed in the prior art that relate to fence attachment structures. These include devices that have been patented and published in patent application publications. While some of these devices relate to fence T-posts, none contemplate the structure of the attachment method of the present invention. The following is a list of devices deemed most relevant to the present disclosure, which are herein described for the purposes of highlighting and differentiating the unique aspects of the present invention, and further highlighting the drawbacks existing in the prior art.

One such device in the prior art is U.S. Pat. No. 8,480,061 to Graves, which discloses a fencing system used in conjunction with a T-post that comprises an upper and lower sleeve that are used to secure a bracket. Bolts extend through the sleeves to secure the bracket, which cooperate with the lugs along the T-post to secure the assembly in place. The bracket forms a connecting arm for securing other structural members to the assembly. The Graves device, while working in conjunction with a T-post, fails to contemplate the structure or the purpose of the present invention, which is designed to replace wire ties and for supporting wire fence against the T-post.

U.S. Pat. No. 6,883,785 to Knapp discloses a T-post bracket that is used to support horizontal stanchions and other structure from the T-post. The bracket comprises a U-shaped structure with a T-shaped cutout therein. The interior of the bracket along a closed end receives the vertical T-post, while an open end opposite of the closed end receives the stanchion member to be supported by the T-post. Fasteners along the legs of the U-shaped member secure the bracket to the T-post and the stanchion. Similar to the Graves, the Knapp device fails to contemplate the structure of purpose of the present invention. The present invention is related to support wire fence pressed against the cap of the fence T-post. The Graves device provides a U-shaped bracket for supporting horizontal members from the T-post.

U.S. Pat. No. 5,439,201 to Landreville discloses a fence bracket that secures over a fence T-post and allows for mounting fence rails thereto. The structure comprises a tubular device to secure over the cross section of the T-post and covers its surfaces. The bracket comprises an outline of a T-shape, whereby the web portion of the bracket includes fastener apertures for securing the bracket through holes in the web of the T-post. The Landreville device is slid over a fence T-post and substantially follows the outer surface thereof. The present invention comprises a pair of complimentary brackets that secure to the cap of the T-post and between a pair of lugs therealong.

U.S. Pat. No. 6,705,598 to Collins discloses a fence post connector that includes a pair of securement arms and a receiving section. The arms secure to a vertical fence T-post, while the receiving section secures a horizontal section of fence to the T-post. The arms are positioned between a pair of lugs along the T-post, while a fastener is secured through the two arms to secure the assembly to the T-post. As with the Knapp and Graves devices, the Collins device does not anticipate or suggest the structure of the present invention, which is directed to a pair of brackets that secure to the cap of a T-post and secure wire fence thereto.

Finally, U.S. Pat. No. 6,619,627 to Salisbury discloses a fence bracket for a T-post that comprises a flat middle portion, an angled upper portion, and an angled lower portion. A slot through the upper portions is used to accept therethrough the T-post, while a notch in the lower portion abuts against a lug along the T-post. The assembly it secured to the T-post using plastic ties or equivalent. While pertaining to T-posts brackets and utilizing the structure of the T-post lugs for support, the Salisbury fails to anticipate the pair of brackets disclosed herein, or the method of wire fence attachment provided thereby.

The present invention comprises a new fence attachment system that secures wire fence to a T-post using a pair of complementary brackets. The brackets secure around the outer edges of T-post flanges and are fastened together. When fastened together and affixed to the T-post, a wire fence is supported by the brackets in a floating condition. It is submitted that the bracket structures and attachment system are not contemplated in the art, and diverge significantly in elements from those devices in the prior art. It is clear that there is a need in the art for an improvement to existing fence post attachment systems. In this regard the instant invention substantially fulfills these needs.

SUMMARY OF THE INVENTION

In view of the foregoing disadvantages inherent in the known types of fence attachment systems now present in the prior art, the present invention provides a new T-post fence attachment system that utilizes a pair of brackets to secure a barbed wire, chain link, straight wire, equivalent fencing to a fence T-post without wire ties.

It is therefore an object of the present invention to provide a new and improved T-post fence attachment system that has all of the advantages of the prior art and none of the disadvantages.

Another object of the present invention to provide a T-post fence attachment system that comprises a pair of complimentary fence brackets that secure around opposing flanges of the T-post and between an upper and lower T-post lug, whereafter the pair of brackets are fastened together.

Another object of the present invention is to provide a T-post fence attachment system comprising a pair of fence brackets that when fastened together to establish an enclosed area within which the wire fence is supported against the T-post.

Another object of the present invention is to provide a T-post fence attachment system that supports wire fencing in a floating condition relative to the T-post, thereby allowing for small movements of the fence if pressed upon by an animal, or if adjustments are necessary during installation.

Another object of the present invention is to provide a T-post fence attachment system that comprises a pair of complementary brackets that secure to existing T-posts, whereby the brackets are reusable after deployment and are designed for repeated use.

A final object of the present invention is to provide a T-post fence attachment system that includes brackets that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
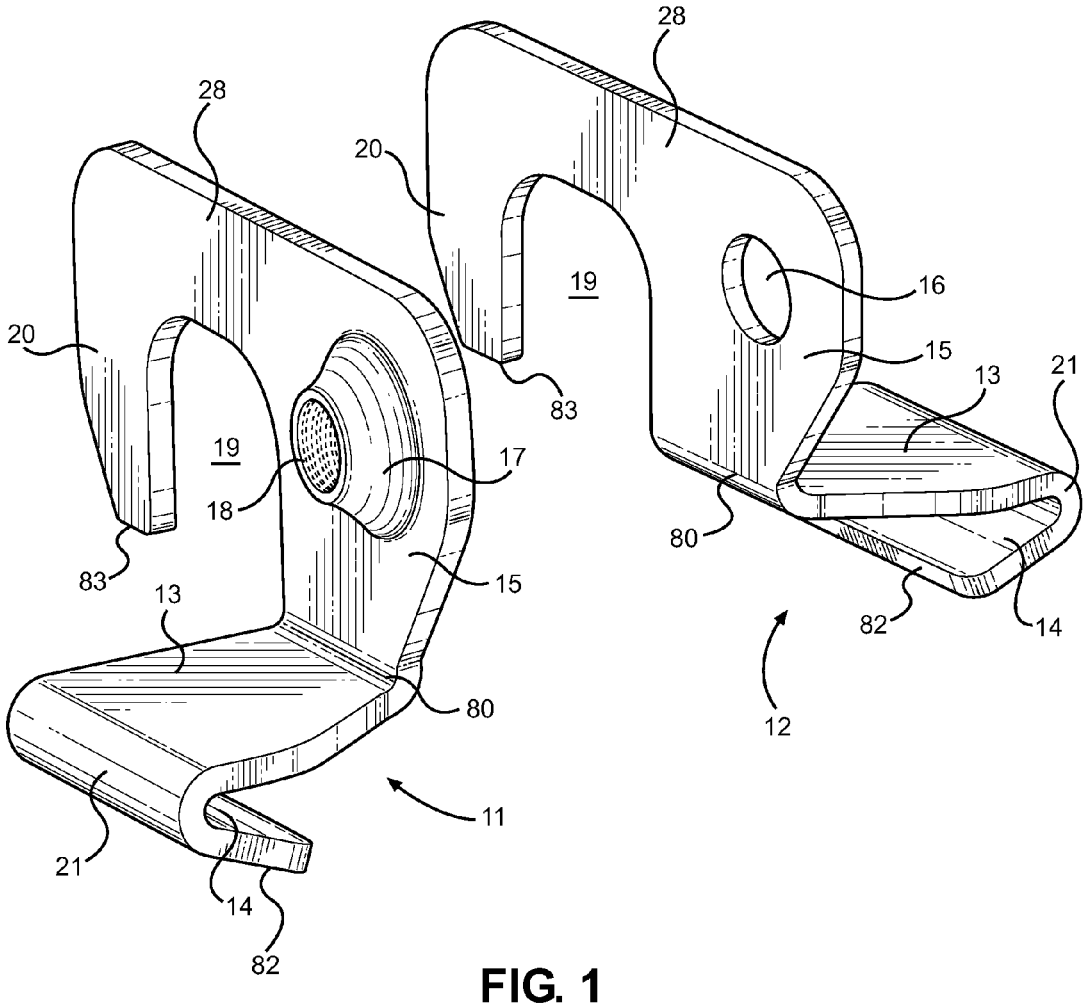
FIG. 1 shows an exploded perspective view of the T-post brackets of the present invention.

Reference is made herein to the attached drawings. Like reference numerals are used throughout the drawings to depict like or similar elements of the T-post fence attachment system of the present invention. For the purposes of presenting a brief and clear description of the present invention, the preferred embodiment will be discussed as used for securing wire fence to a fence T-post using a pair of reusable brackets. The figures are intended for representative purposes only and should not be considered to be limiting in any respect.

Referring now to FIG. 1, there is shown a perspective view of the post fence attachment system of the present invention. The system comprises a pair of brackets, comprising a first bracket 11 and a second bracket 12. The brackets are a complimentary pair that affix to the cap of a fence T-post between a pair of lugs protruding therefrom. The brackets align with one another and secure to the outer edges of the T-post cap, whereafter the brackets are fastened together. The lugs of the T-post and the geometry of the fastened brackets prevent movement along the T-post, while the brackets provide a location within which to secure a portion of a wire fence against the T-post.

The first bracket 11 and second bracket 12 each comprises a base surface 13 that is configured to be abutted against the cap of a T-post. The base surface 13 is a planar surface having an outer distal end 21 and an inner end 80. The distal end 21 of the brackets comprises an extension of the base surface that folds back onto itself below the base surface 13 to form a U-shaped fitting 14. The U-shaped fitting 14 is configured to secure around the outer edge of the T-post flange and hug the same. The fitting 14 extends downward and toward the inner end of the base surface to form a U-shaped hook-type fitting with an inner pocket and an outer flange 82. The radius of the fitting 14 is configured to coincide and/or accommodate the thickness of the T-post cap at its outer edge.

Along the inner end 80 of the base surface 13, an upstanding portion 15 extends upward and substantially perpendicularly therefrom. The upstanding portion 15 supports two functions: a means of fastening the pair of brackets together, and furthermore a means of enclosing a portion of the wire fence between the brackets and the T-post once installed. To accomplish the latter function, the upstanding portion 15 extends forward from the base surface 13 and includes an open notch 19 therealong. The open notch 19 is a cut-out of removed material from the upstanding portion 15 along the lower edge thereof, extending upwards and forward of the base surface 13. The forward portion forms an enclosed leading end 20 that is configured to enclose the opening 19, through which a wire fence is placed (i.e. within the open notch) when the T-post is abutted against the lower edge 83 of the upstanding portion 13. The forward end of the upstanding portion 15 comprises an upper portion 28 above the open notch 19, and a leading end 20 extends downward therefrom. The open notch 19 forms an enclosed opening through which wire fence is supported against the T-post.

Figure 2:
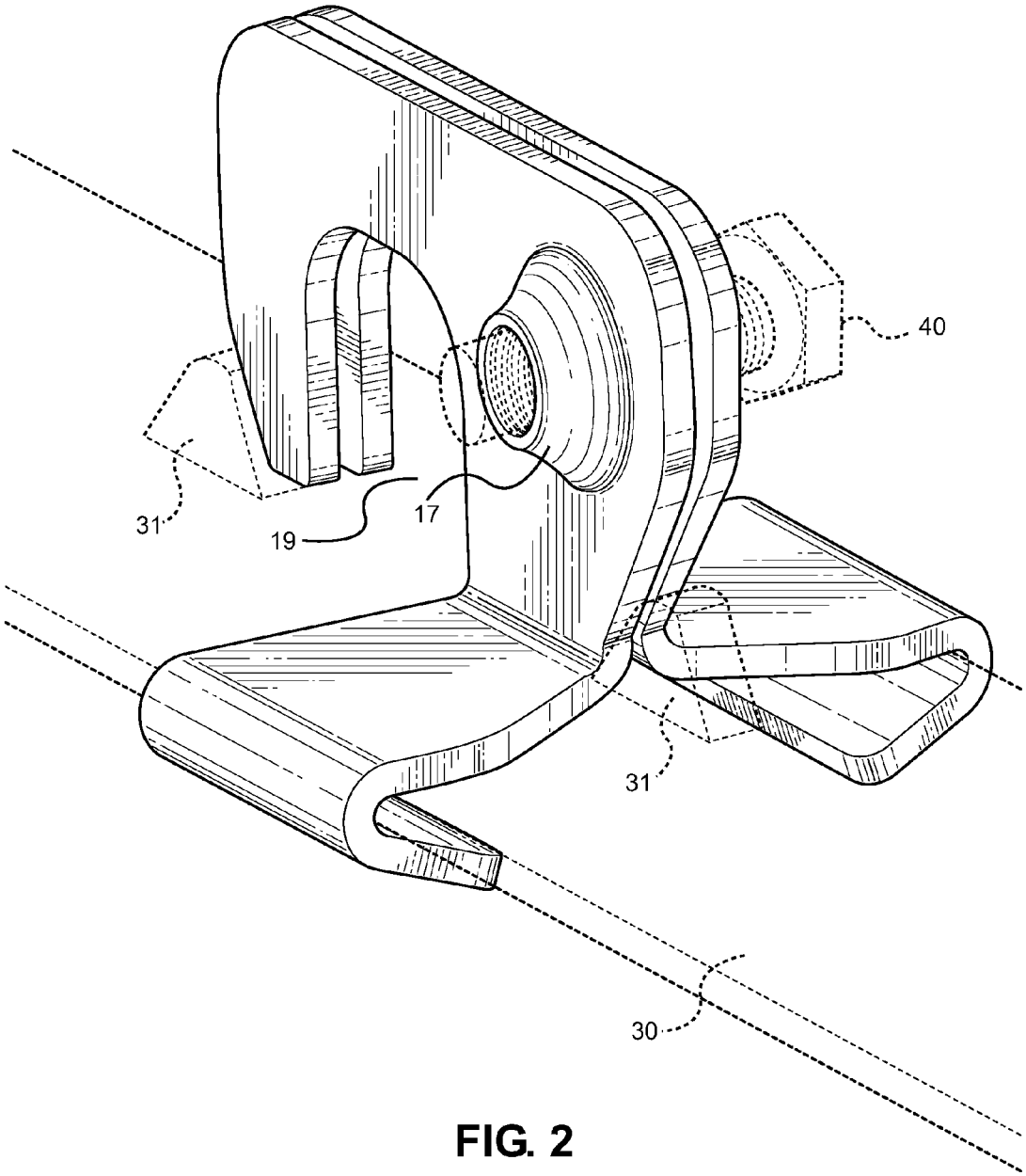
FIG. 2 shows a perspective view of the T-post brackets in a working state attached to a T-post.

Referring now to FIGS. 1 and 2, the method of attaching the brackets together is shown. Above the base surface 13 along the upstanding portion 15 is a fastener aperture disposed on each bracket. The first bracket 11 comprises a protruding fastener aperture 17 with a preferably threaded interior surface 18. The second bracket comprises a flush fastener aperture 16 that is configured to freely receive a fastener 40 therethrough. In this manner, a fastener 40 can be extended through the fastener aperture 16 of the second bracket and into the threaded fastener aperture 17 of the first bracket 11. The threaded fastener 40 engages the threads of the threaded aperture 17 to draw the two brackets together and fasten the two together.

Embodiments of this joint are contemplated. These include having a minimally protruding aperture 17 along the first bracket, as well as utilizing fastener apertures without internal threads. The latter configuration requires the threaded fastener 40 to be secured using a fastener nut along the opposing side of the brackets once inserted through both.

Figure 3:
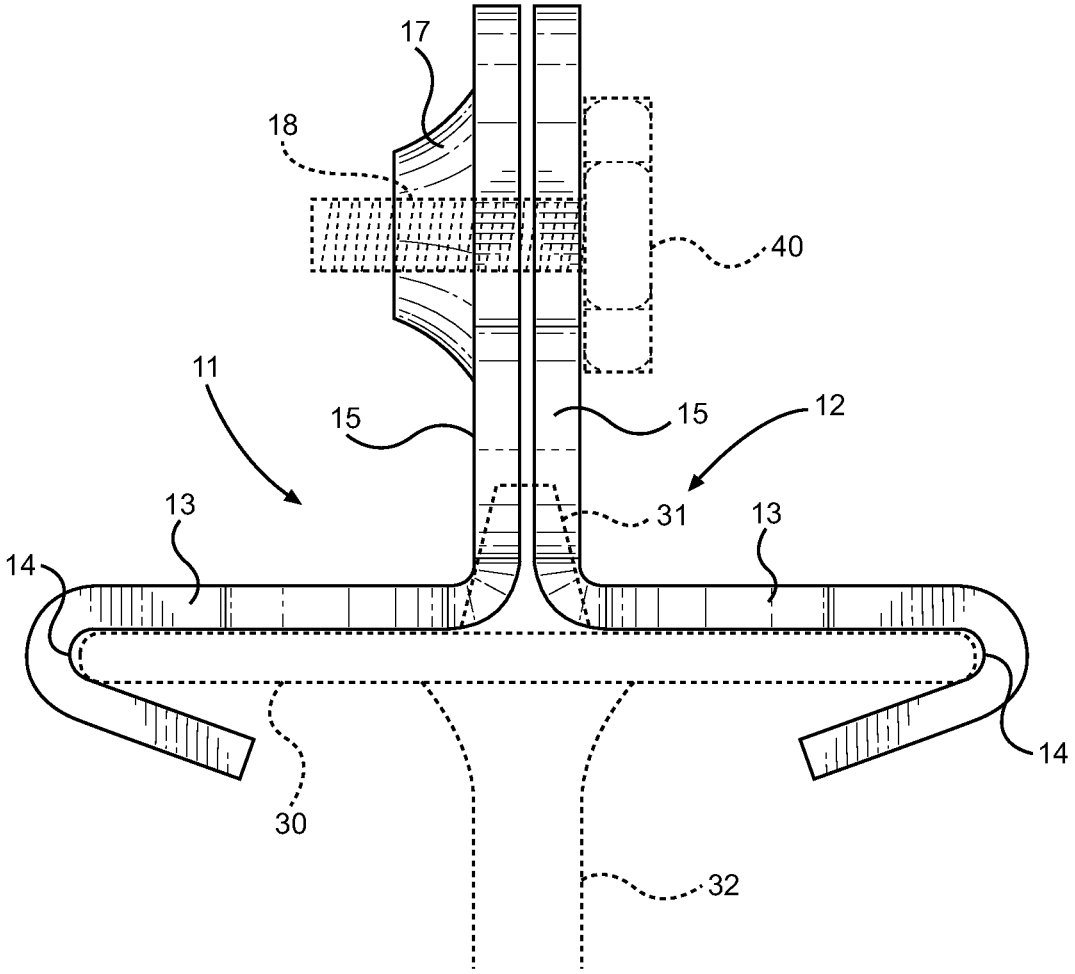
FIG. 3 shows an end view of the T-post brackets in a working state attached to a T-post.

Referring now to FIGS. 2 and 3, there are shown views of the brackets in an installed state. The first 11 and second 12 brackets form complimentary pairs that have a mirrored configuration when mated together. The upper portions 15 of each are pressed against one another such that the base surfaces 13 thereof extend outward and away from one another. The apertures of the upper portions 15 are aligned and a fastener is positioned through the apertures to secure the upper potions together. When installing the brackets, the geometry of the T-posts is utilized to statically secure the brackets together and secure the brackets to the T-post itself. Description f the T-post is therefore required to highlight the usefulness of the brackets.

Typical fence T-posts comprise vertical members having a T-shaped or I-shaped cross section. The cross section includes a web portion 32 and a perpendicular cap 30. The cap 30 comprises an elongated length and an outer surface that is disposed opposite of the T-post web 32. Along the outer surface is a plurality of aligned and spaced apart lugs 31, which are protrusions extended outward from the outer surface. The lugs 31 are generally used to secure fence structure to the T-post. The present invention utilizes the spacing of the lugs 31 and the outer edges of the cap 31 to secure the brackets to the T-post after the brackets have been aligned and fastened together. Once installed, the open notches 19 of the brackets are aligned and form an enclosed region within which to support wire fence, whereby the cap 30 of the T-post, the lug 31, and the inner edge of the brackets around the periphery of the open notches 19 enclose a portion of wire fence therein.

Referring specifically to FIG. 3, an end view of the brackets is shown and a downward view of the vertical T-post is provided. The brackets 11, 12 are fastened together using a fastener 40 through the aligned apertures thereof, whereby preferably the threaded inner surface 18 of the protruding fastener aperture 17 secures the fastener 40 to the first bracket 11. Prior to fastening the brackets, the U-shaped outer fittings 14 are secured over the outer edges of the T-post cap 30 and the upper portions 15 of the brackets are pressed against one another. The length of the base surface 13 is such that the upper portions 15 align and abut one another when the fittings 14 fully receive the outer edges of the T-post cap 30.

Figure 4:
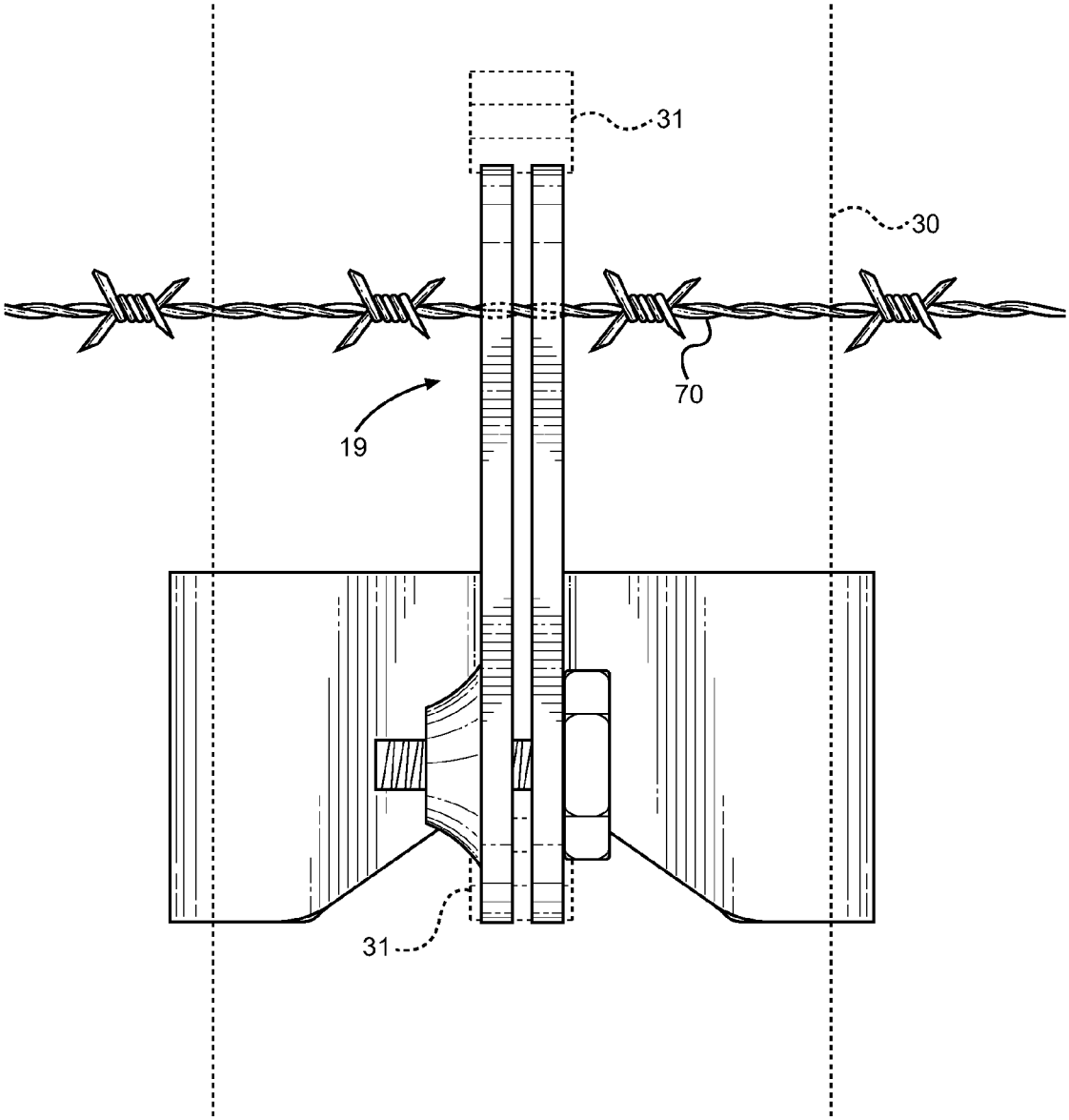
FIG. 4 shows an overhead view of the T-post brackets in a working state attached to a T-post and securing a barbed wire fence thereto.

Referring now to FIG. 4, there is shown a frontal view of the T-post fence attachment system of the present invention in a working state, supporting a barbed wire fence 70 against a T-post cap 30. The brackets are fastened together and positioned between the lugs 31 of the T-post cap 30. The enclosed open notches 19 of the brackets support a segment of the barbed wire fence 70, thereby preventing the wire 70 from moving substantially away from the T-post cap either laterally or outwardly therefrom. If a chain link fence is retained, Individual links may be supported by the brackets along the length of the T-post. The open notches 19 of each set of brackets allow the wire fence (regardless of type) to "float" relative to the T-post. This "float" is incremental movement between the links 71 and the brackets, whereby the open notch is oversized and does not statically constrain each of the wire 70 along the T-post. Once the wire (or after several links of a chain link fence) are secured to a T-post, the overall fence can move incrementally relative to the T-post. This allows the fence to accommodate large displacement when being pressed by a large animal, and also facilitates ease of installation by allowing for incremental repositioning of the fence along the T-post when securing the brackets thereto.

Figure 5:
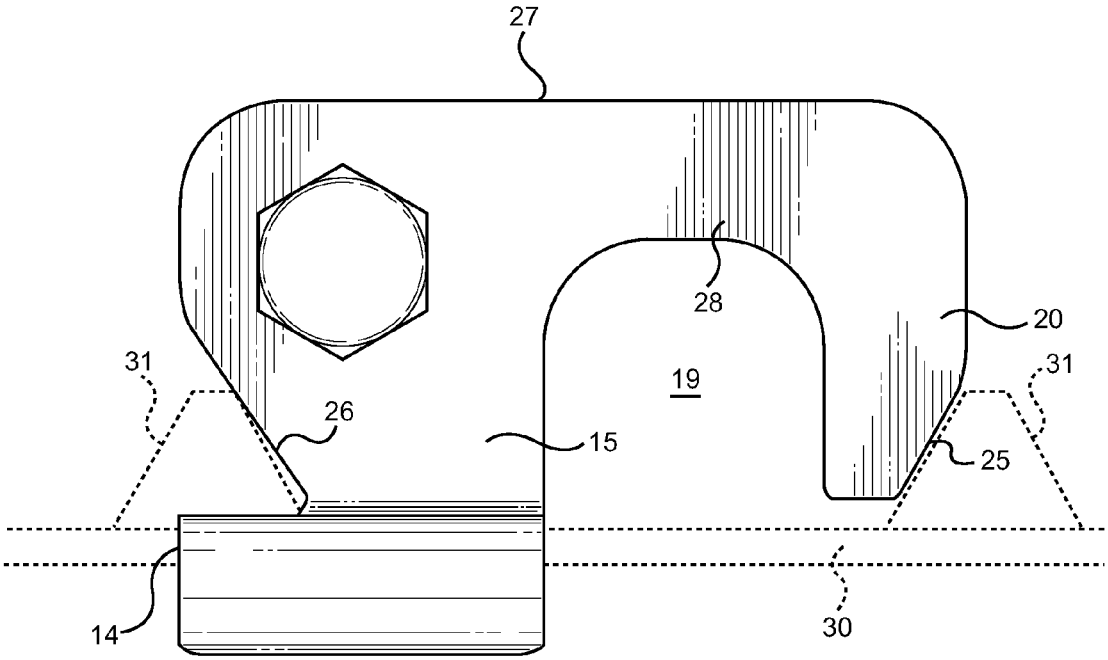
FIG. 5 shows a side view of the T-post brackets in a working state.

Referring to FIG. 5, there is shown a side view of the brackets in an installed state. The present invention comprises a fence post brackets that secure a wire fence to a fence T-post and fasten together. The enclosed open notches 19 secure the wire fence between the upper portions 15 of the brackets, the T-post cap 30, and the T-post lugs 31. The upper portions 15 form a hook configuration comprising an upper portion 28 and an enclosed leading end 20. The enclosed leading end 20 may further include a chamfered forward edge 25 that aligns with the surface of the T-post lug 31, while the rear edge 26 of the upstanding portion comprises a similarly chamfered edge that aligns with the adjacent lug 31. The base of the bracket extends perpendicularly with regard to the upstanding portion and includes a distal end, U-shaped fitting 14. The fitting 14 is configured to secure around an exposed outer edge of a T-post cap 30, while the base of the brackets bear against the T-post cap 30 while the upstanding portion 15 is extends outward therefrom.

The two complimentary brackets having a largely mirrored geometry, wherein the two are placed back-to-back along the T-post flange to engage opposing T-post cap edges and position the upstanding portions of each bracket along the flange and against one another. The two brackets are thus disposed in an adjacent relationship and are positioned along the T-post between a pair of T-post lugs extending therefrom. Together, the two brackets are fastened together through the aligned fastener apertures, while the open notches of the two brackets align to create an enclosed region between the brackets and the T-post. During installation, a portion of the fence is positioned within this enclosed region, whereafter it is secured therein until the brackets are removed from the fence post.

The secure the first and second brackets together, a fastener is positioned through the apertures of the brackets. The fastener engages a preferably pre-tapped hole in the first bracket. Alternatively, the fastener is configured to be secured with a fastener nut and not threadably engage either bracket. In yet another alternative, the threaded fastener may be self-tapping and create threads in the first bracket fastener aperture when threadably inserted therethrough. Once the brackets are fastened together and in a working state, a pair of T-post flange lugs prevents the brackets from sliding along the T-post length. The ends of the bracket, notably along the leading end and the rear end of the upstanding portion, are sandwiched between the lugs. The brackets are configured to be sized accordingly in length to be positioned between lugs, and furthermore having base surfaces such that the upstanding portions of the brackets abut while the U-shaped fittings engage the outer edges of the T-post cap.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fence attachment system for attaching a wire fence to a T-post, said T-post comprising a cap portion with a perpendicular web portion extending centrally from a side of the cap portion and a plurality of spaced apart lugs on an opposite side, said fence attachment system comprising:

a pair of brackets having a substantially mirrored configuration, each bracket comprising:

a base surface having an inner end and an outer end;

an upstanding portion extending substantially perpendicularly from said base surface at said inner end, and comprising an aperture therethrough receiving a fastener; and a U-shaped fitting extending downward from said outer end of said base surface;

said upstanding portions further comprising a leading end having a hook-configuration with a lower edge and an open notch extending from said lower edge into said leading end, said lower edge being substantially within the same plane as said base surface;

wherein in an assembled state, the U-shaped fittings of the brackets engage opposing edges of the cap portion of the T-post, the base surfaces and lower edges abut the cap portion, and the upstanding portions of the brackets are aligned between two adjacent lugs such that the open notches provide an enclosed area for supporting the wire fence while allowing incremental movement of the wire fence.

2. The fence attachment system of claim 1, wherein said fastener aperture of at least one of said pair of brackets comprises a threaded inner surface configured to threadably receive a threaded fastener.

3. The fence attachment system of claim 1, wherein said base surface of each bracket is configured to have a length between said inner end and said outer end such that said U-shaped fitting of each bracket secures around an outer edge of a T-post cap, while said upstanding portions of said brackets abut against one another.

4. The fence attachment system of claim 1, wherein:

said upstanding portion further comprises a forward edge and a rear edge;

said upstanding portion having a length such that said forward edge and said rear edge substantially abut against two adjacent lugs of the T-post when positioned therebetween.

5. A method of securing a wire fence to a T-post, comprising the steps of:

providing a wire fence;

providing a T-post, said T-post comprising a cap portion with a perpendicular web portion extending centrally from a side of the cap portion, and a plurality of spaced apart lugs on an opposite side of the cap;

providing a pair of brackets having a substantially mirrored configuration, each bracket comprising:

a base surface having an inner end and an outer end;

an upstanding portion extending substantially perpendicularly from said base surface at said inner end, and comprising an aperture therethrough; and a U-shaped fitting extending downward from said outer end of said base surface;

said upstanding portions further comprising a leading end having a hook-configuration with a lower edge and an open notch extending from said lower edge into said leading end, said lower edge being substantially within the same plane as said base surface;

aligning the brackets such that the respective apertures and open notches thereof are substantially aligned;

securing a portion of the wire fence within the aligned open notches of the brackets;

securing the U-shaped fittings of the brackets onto opposite edges of the cap portion such that the base surfaces and lower edges abut the cap portion; and securing the brackets together via a fastener through the apertures.

* * * * *